US007601917B2

(12) United States Patent
Zamzow et al.

(10) Patent No.: US 7,601,917 B2
(45) Date of Patent: Oct. 13, 2009

(54) ELECTRICAL CONNECTION LINE FOR AN ELECTRICAL UNIT OF A MOTOR VEHICLE

(75) Inventors: Peter Zamzow, Bochum (DE); Wolfgang Scheideler, Leuchtenberg (DE); Helmut Steinberg, Störnstein (DE); Udo Mayer, Weiden (DE)

(73) Assignee: Nexans (FR)

( * ) Notice: Subject to any disclaimer, the term of this patent is extended or adjusted under 35 U.S.C. 154(b) by 0 days.

(21) Appl. No.: 11/977,428

(22) Filed: Oct. 23, 2007

(65) Prior Publication Data

US 2008/0135275 A1 Jun. 12, 2008

(30) Foreign Application Priority Data

Nov. 10, 2006 (EP) ..... 06291765

(51) Int. Cl.
*H01B 7/00* (2006.01)

(52) U.S. Cl. ..... 174/113 R

(58) Field of Classification Search ..... 174/113 R, 174/75 C, 78, 88 C; 439/608, 610
See application file for complete search history.

(56) References Cited

U.S. PATENT DOCUMENTS 2,261,742 A * 11/1941 Matsumoto ..... 174/21 R
3,990,765 A * 11/1976 Hill ..... 439/610
4,382,653 A * 5/1983 Blanchard ..... 439/610
4,579,415 A * 4/1986 Van Brunt et al. ..... 439/608
6,143,987 A 11/2000 Makita ..... 174/74

* cited by examiner

*Primary Examiner*—Chau N Nguyen
(74) *Attorney, Agent, or Firm*—Sofer & Haroun, LLP

(57) ABSTRACT

An electrical connection line (L) for an electrical unit of a motor vehicle, which electrical connection line serves to electrically connect the unit to an electrical power source which is arranged in the motor vehicle and/or to another electrical unit. The connection line (L) is designed as a three-phase line with three insulated electrical conductors (1, 2, 3), of which each has an electrical individual sheath (5) which is in contact with its insulation means (4) and is closed all the way around. An electrical outer sheath (7) which surrounds the three sheathed conductors (1, 2, 3) and is closed all the way around is also provided and a coupling element which is equipped with electrical contacts which are insulated from one another is fitted at least to one end of the connection line (L) in a moisture-tight manner, and the electrical conductors (1, 2, 3), their individual sheaths (5) and the outer sheath (7) are electrically conductively connected to the contacts of the said coupling element.

3 Claims, 2 Drawing Sheets

ELECTRICAL CONNECTION LINE FOR AN ELECTRICAL UNIT OF A MOTOR VEHICLE

RELATED APPLICATION

This application claims the benefit of priority from European Patent Application No. 06291765.3, filed on Nov. 10, 2006, the entirety of which is incorporated herein by reference.

FIELD OF THE INVENTION

The invention relates to an electrical connection line for an electrical unit of a motor vehicle, which electrical connection line serves to electrically connect the unit to an electrical power source which is arranged in the motor vehicle and/or to another electrical unit.

BACKGROUND

A connection line of this type can be used in motor vehicles which are driven by an electric motor, particularly advantageously in motor vehicles which have an internal combustion engine and an electric motor. A corresponding motor vehicle is known as a "hybrid car" and is also called such in the text which follows. A hybrid car is equipped with two different motors: an internal combustion engine (petrol or diesel) and an electric motor. It is possible to optionally change over from one motor to the other using known technology. When the hybrid car is operated using the electric motor, no exhaust gases are produced. This is particularly advantageous for city driving. The electric motor is fed from a correspondingly dimensioned power source. It can also be operated such that it generates additional power when the internal combustion engine is still operating, so that both motors then act as drives for the hybrid car. This option may be advantageous particularly when driving uphill and also when overtaking.

In known technology, the electric motor is a three-phase motor for whose operation an alternating current is generated by an inverter which is likewise accommodated in the hybrid car and is connected to a power source. The power source is, for example, an energy-storage means which comprises a large number of capacitors (ultracaps) and can be accommodated, for example, in the boot of a hybrid car. The capacitance of the capacitors is sufficient for brief operation of the electric motor. They are recharged, for example during braking of the motor vehicle, by the electric motor which then acts as a generator. In order to operate, the electric motor is connected to the inverter by means of an electrical connection line, and the inverter, for its part, is connected to the energy-storage means via an electrical connection line. Accordingly, "units" are, in particular, the electric motor, the inverter and the energy-storage means. Fail-safe connection lines are required for the electrical connections of the units.

EP-A-0 901 193 discloses an electrical connection line with a coupling element which is fitted to one end of the said electrical connection line in a moisture-tight manner. This connection line is designed as a three-phase line with three insulated electrical conductors which are surrounded by an electrical outer sheath which is closed all the way around.

OBJECTS AND SUMMARY

The object of the invention is to design the connection line described in the introduction such that it is electrically fully effectively screened for problem-free operation of the motor vehicle, including the connected coupling elements.

In order to achieve this object, the connection line according to the invention is designed as a three-phase line with three insulated electrical conductors which are surrounded by an electrical outer sheath which is closed all the way around, in which electrical connection line a coupling element is fitted at least to one end in a moisture-tight manner, in which electrical connection line each conductor has an electrical individual sheath which is in contact with its insulation means and is closed all the way around, and in which electrical connection line the coupling element is equipped with electrical contacts which are insulated from one another and to which the electrical conductors, their individual sheaths and the outer sheath are electrically conductively connected.

This connection line meets all the requirements made for use in a motor vehicle—called "vehicle" for short in the text which follows. The said connection line, including the connected coupling elements, are electrically fully effectively screened, so that no interfering electromagnetic fields are transmitted by the line and no interfering radiation can enter the said line either. This is also the case when only one coupling element is fitted to the line and the other end is connected in a unit. Since the coupling element or the coupling elements is/are connected to the line in a moisture-tight manner, the said line also meets all the mechanical requirements for the harsh ambient conditions during operation of a vehicle.

In principle, the individual sheaths of the conductors can be jointly connected to one contact of a coupling element. However, in one preferred embodiment, they are also connected to a dedicated contact separately from one another, like the conductors and the outer sheath. In this advantageous embodiment, the individual sheaths can additionally be used to monitor the ability of the respective conductor to function. The said individual sheaths are then connected to a suitable sensor system.

BRIEF DESCRIPTION OF THE DRAWINGS

Exemplary embodiments of the subject matter of the invention are illustrated in the drawings, in which.

DETAILED DESCRIPTION

Figure 1:
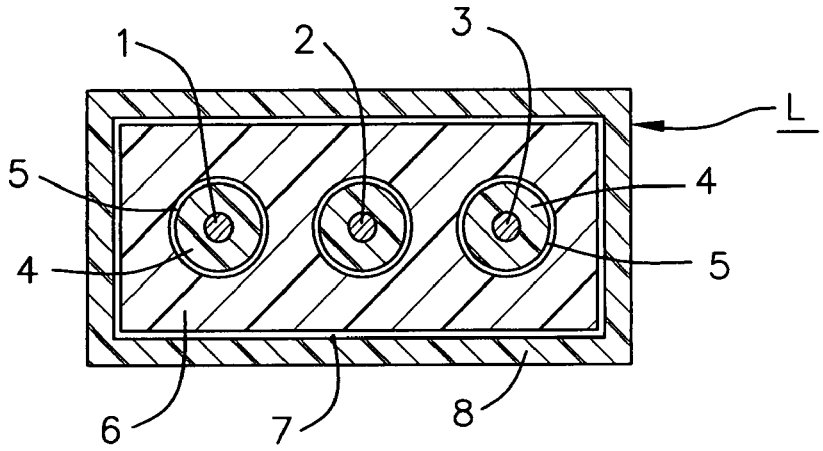
FIGS. 1 and 2 show cross sections through two different embodiments of a connection line according to the invention.

FIG. 1 illustrates a three-phase connection line L which is designed as a flat line in which three electrical conductors 1, 2 and 3 are arranged such that they run parallel to one another and lie in one plane. Each of the conductors 1, 2 and 3 is surrounded by an insulation means 4 over which an electrical individual sheath 5 is fitted in each case. The three sheathed conductors are surrounded by a common insulating body 6 over which an electrical outer sheath 7 is arranged. In order to protect the outer sheath 7, a jacket 8 which is composed of insulating material can further be arranged over the said outer sheath. Elements of high tensile strength, such as aramid threads, can also be arranged in the insulating body 6 as strain-relief means for the connection line L.

The conductors 1, 2 and 3 can be designed as solid conductors or as stranded conductors. They are preferably composed of materials of high electrical conductivity in accordance with EN or DIN. Copper, aluminium or combined materials which can also contain silver or gold can advantageously be used and a high tensile strength of the conductor can be guaranteed when used in conjunction with zinc. The conductors used can also be copper-plated steel wire or aluminium wire.

All substances which are known as electrical insulating materials can, in principle, be used for the insulation means 4 of the conductors 1, 2 and 3. These substances are advantageously polyvinyl chloride, rubber, silicone, polyethylene and polypropylene, for example. The electrical individual sheaths 5 and the outer sheath 7 can be designed as single- or double-braids composed of copper wires. However, metal foils which are coated with plastic on one side and are wound around the insulation means 4 of the conductors 1, 2 and 3 in one or two layers can also be used.

A coupling element K which is equipped with contacts 9 which are insulated from one another is connected at least to one end of the connection line L in a moisture-tight manner. The contacts 9 can be designed as pins or sockets. The conductors 1, 2 and 3, their individual sheaths 5 and the outer sheath 7 are connected to the contacts 9. The coupling element K has a protective body (not illustrated for reasons of simplicity) which is composed of insulating material and is fitted to the end of the connection line L in a moisture-tight manner by injection-moulding. The individual sheaths 5 and the outer sheath 7 are at the same potential, preferably earth potential. They can therefore be jointly connected to one contact 9 of the respective coupling element K. However, it is also possible to connect the individual sheaths 5 and the outer sheath 7, like the conductors 1, 2 and 3, to a dedicated contact 9 in each case.

In the embodiment of the connection line L as a flat line according to FIG. 1, the conductors 1, 2 and 3 and therefore their individual sheaths 5 are insulated from one another and from the outer sheath 7 by the insulating body 6. In this embodiment of the connection line L in particular, the individual sheaths 5 can each be connected to a dedicated contact 9 of a coupling element K and possibly to a dedicated contact in a unit of a vehicle. They can then be individually used on a sensor system for monitoring the ability of the associated conductor 1, 2 or 3 to function. Therefore, any damage to the conductors 1, 2 and 3 can be easily and quickly identified.

Figure 4:
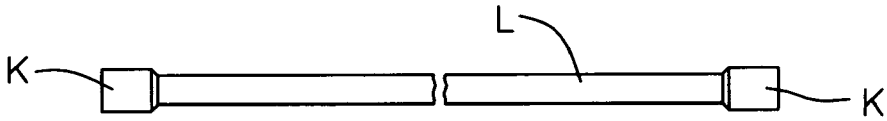
FIGS. 4 and 5 show views of two different refinements of the connection line.
Figure 5:
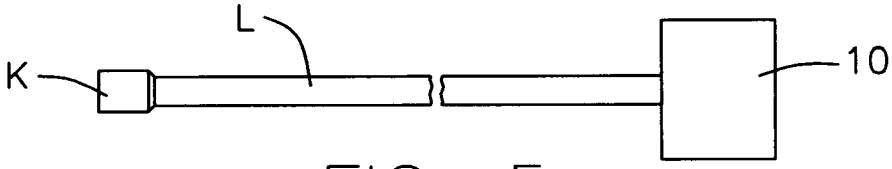
Figure 3A:
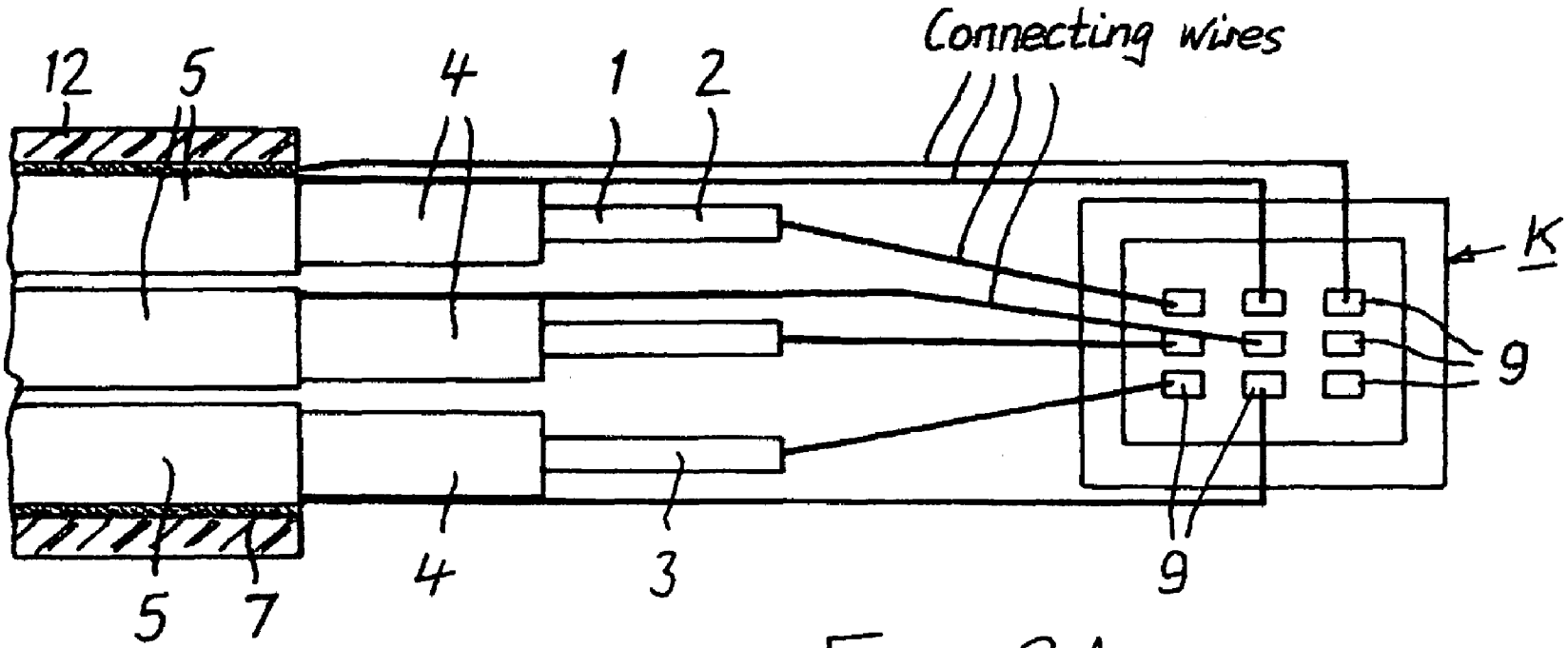
FIG. 3A is a schematic view showing the electrical conductors, their individual sheaths and the outer sheath, separately from one another, electrically conductively connected to one contact of the respective coupling element.

According to FIG. 4, a coupling element K can be fitted to both ends of the connection line L. However, according to FIG. 5, it is also possible to permanently connect one end of the connection line L to the contacts of an electrical unit 10. The individual sheaths 5 can—as already mentioned—be connected separately from one another in the unit 10 too. In both embodiments, the connection line L can be used particularly to connect an electric motor of a vehicle to an inverter and to connect the inverter to an energy-storage means. The said connection line can advantageously be permanently connected to the inverter as early as during manufacture and then has a coupling element K for plug connection to another unit only at the free end.

Figure 2:
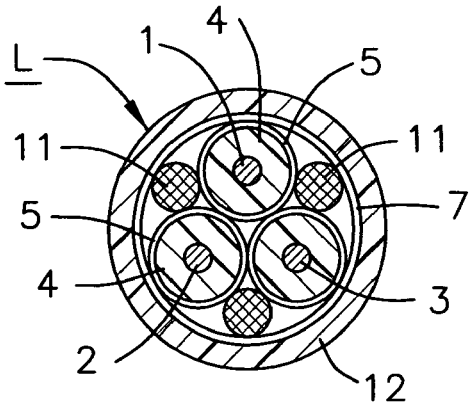
Figure 3:
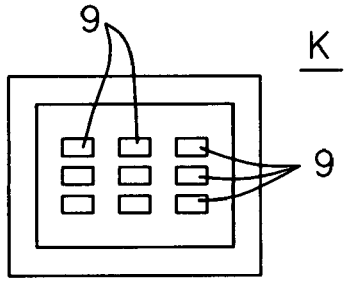
FIG. 3 shows a schematic illustration of a plan view of the insertion side of a coupling element which is fitted to the line.

In an embodiment of the connection line L according to the illustration in FIG. 2, the three conductors 1, 2 and 3 are stranded with one another. In this case, their individual sheaths 5 make contact with one another and the outer sheath 7 is fitted directly around the individual sheaths 5. In this embodiment of the connection line L, the outer sheath 7 can also be designed as a closed pipe which is preferably composed of copper and can be corrugated in order to improve its ability to bend transverse to its longitudinal direction. Filling elements 11 in the gaps between the bottom halves of the conductors 1, 2 and 3 serve to fill a possibly circular cross section of the connection line L. They can also be designed as elements of high tensile strength. A jacket 12 which is composed of insulating material is arranged over the outer sheath 7. Since the sheaths 5 and 7 are at the same potential, preferably earth potential, they can—as already mentioned—be connected to a common contact 9 of the respective coupling element K in this embodiment of the connection line L.

It is possible to individually connect the sheaths to the contacts 9 of a coupling element K or of a unit 10 in the embodiment of the connection line L according to FIG. 2 with stranded, sheathed conductors 1, 2 and 3 too. To this end, only one additional layer which is composed of insulating material needs to be fitted over each individual sheath 5 for DC isolation of the sheaths.

The invention claimed is:

1. Electrical connection line for an electrical unit of a motor vehicle, which electrical connection line serves to electrically connect the unit to an electrical power source which is arranged in the motor vehicle and/or to another electrical unit, said electrical connection line comprising:

a three-phase line with three insulated electrical conductors which are surrounded by an electrical screen which is closed all the way around, in said electrical connection line a coupling element is fitted at least to one end in a moisture-tight manner, in said electrical connection line each conductor has an electrical individual sheath which is in contact with its insulation means and is closed all the way around, in said electrical connection line the coupling element is equipped with electrical contacts which are insulated from one another and to which the electrical conductors, their individual sheaths and the electrical screen are electrically conductively connected, and in which said electrical conductors, their individual sheaths and said electrical screen are, in each case separately from one another, electrically conductively connected to one contact of the respective coupling element, in each case.

2. Arrangement according to claim 1, wherein another coupling element is fitted to the other end of the connection line in a moisture-tight manner, and the electrical conductors, their individual sheaths and the electrical screen are electrically conductively connected to the contacts of said coupling elements.

3. Arrangement according to claim 1, wherein the connection line is equipped with the coupling element at said at least one end, whereas its conductors, their individual sheaths and the electrical screen are connected to contacts of an electrical unit at its other end.

* * * * *